US009666169B2

(12) United States Patent
West et al.

(10) Patent No.: US 9,666,169 B2
(45) Date of Patent: May 30, 2017

(54) FINGERNAIL PICK APPARATUS AND METHOD

(71) Applicant: GLISSPHONIC LLC, San Rafael, CA (US)

(72) Inventors: Jack Raymond West, San Rafael, CA (US); Britton Yates West, Watkinsville, GA (US)

(73) Assignee: GLISSPHONIC LLC, San Rafael, CA (US)

( * ) Notice: Subject to any disclaimer, the term of this patent is extended or adjusted under 35 U.S.C. 154(b) by 0 days.

(21) Appl. No.: 15/001,005

(22) Filed: Jan. 19, 2016

(65) Prior Publication Data

US 2016/0210940 A1 Jul. 21, 2016

Related U.S. Application Data

(60) Provisional application No. 62/105,708, filed on Jan. 20, 2015.

(51) Int. Cl.
*G10D 3/16* (2006.01)

(52) U.S. Cl.
CPC ..... *G10D 3/163* (2013.01)

(58) Field of Classification Search
CPC ..... G10D 3/163; G10D 1/005
USPC ..... 84/320–322
See application file for complete search history.

(56) References Cited

U.S. PATENT DOCUMENTS 4,843,942 A * 7/1989 Ishizuka ..... G10D 3/163 84/322
5,413,123 A 5/1995 Aylott
7,179,976 B2 2/2007 West

* cited by examiner

*Primary Examiner* — Kimberly Lockett
(74) *Attorney, Agent, or Firm* — Gordon Rees Scully Mansukhani LLP; David R. Heckadon

(57) ABSTRACT

A fingernail pick having improved fingernail attachment systems and playing surfaces that are shaped for improved sound quality and ease of playing of stringed instruments.

12 Claims, 15 Drawing Sheets

FIG 8B
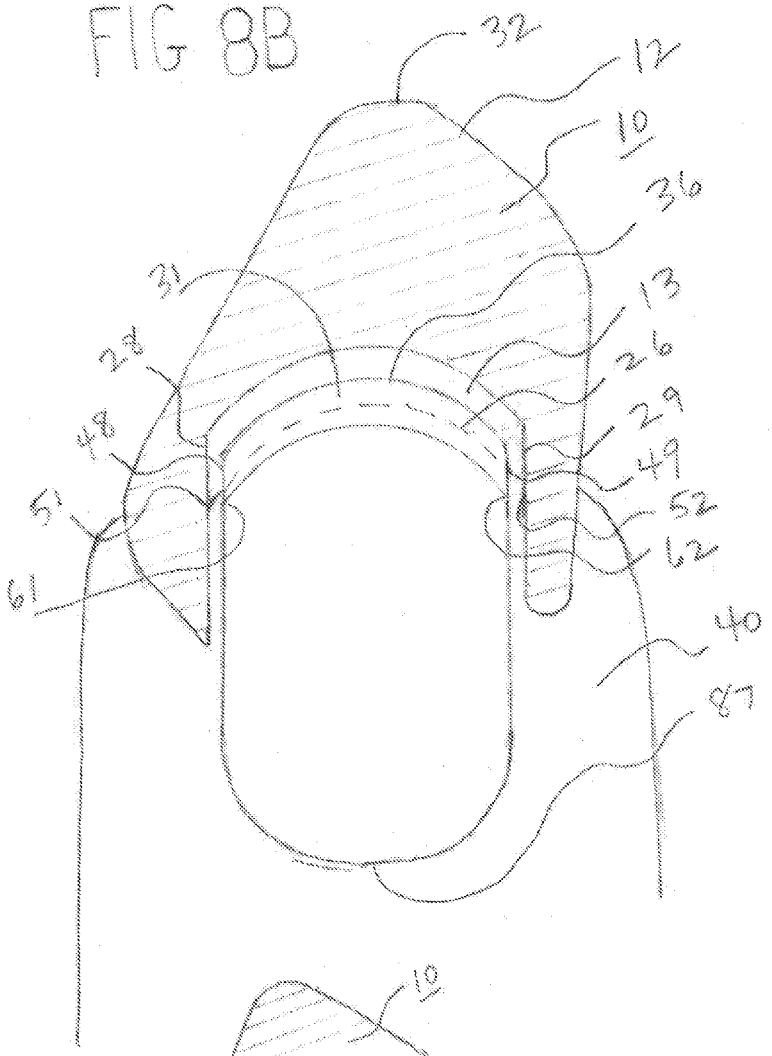
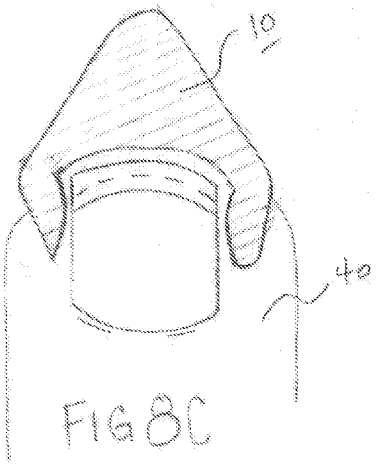
FIG 8C
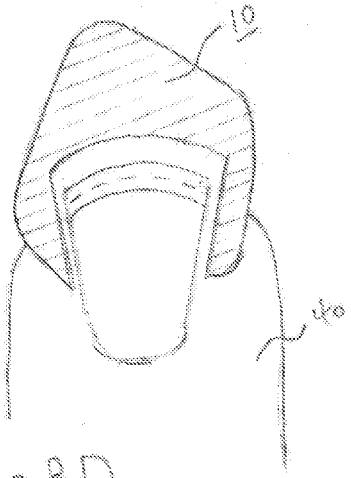
FIG 8D
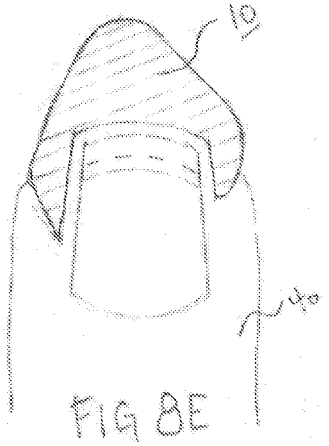
FIG 8E

FINGERNAIL PICK APPARATUS AND METHOD

RELATED APPLICATION

The present application claims priority from U.S. Provisional Patent 62/105,708 of same title, filed Jan. 20, 2015, the entire disclosure of which is incorporated herein by reference in its entirety for all purposes.

TECHNICAL FIELD

The present invention relates to fingernail mounted picks for playing stringed instruments.

BACKGROUND

Prior art fingerpicks for use on stringed instruments may have numerous problems as discussed in U.S. Pat. No. 7,179,976 (issued to applicant for this case, Jack R. West, formerly known as John R. West), incorporated by reference herein in its entirety. Additional problems with picks that attach to the fingernail may include: providing a playing surface on the underside of the pick that smoothly transitions the string from the fingertip flesh onto the pick at the location where the underside of the pick meets the flesh (so that the pick does not "catch" on the string during activation thereof); providing an adhesive layer on an anchor portion of the body of the pick that minimizes a height of the pick where it meets the cuticle (to prevent string "catching" near the cuticle); providing a low cost manufacturing method for fingernail picks; providing a slot in a fingernail pick that provides significant resistance to lateral forces on the pick; providing a pick that increases the playing surface on the underside (to improve playability) without making the overall pick so wide that it interferes with adjacent fingers or fingernail picks; providing a fingernail pick that fits snugly given the variety of fingernail sizes and shapes amongst the general population; providing a reliable method of sizing a fingernail pick for a specific fingernail; providing a simplified method of measuring the dimensions of a fingernail that are relevant to providing a snug fitting pick; providing a fingernail pick slot that substantially aligns with the crescent-shaped distal end of the cantilevered portion of a fingernail; providing a fingernail pick slot that is shaped to maximize the amount of cantilevered nail that can be inserted therein; and providing a line of fingernail picks that vary the fit of the pick on the user's nail while maintaining a substantially consistent outside shape and playing surfaces; and other issues.

SUMMARY

The present system describes significant advancements in fingernail pick technology resulting in improvements in ease of playing stringed instruments, improved sound performance of stringed instruments, reduced wear and tear on the fingernails of stringed instrument players, and improvements in the manufacture of fingernail picks.

In one preferred aspect, the present system describes fingernail picks having underside playing surfaces that are inwardly tapered with a bottom thumb-facing edge that digs slightly down into the flesh of the musician's finger. The advantage of this aspect is that it affords an easy and rapid transition of the string from the finger to the underside of the fingernail pick. Simply, the string is much less likely to catch on the bottom edge of the fingernail pick due to a proximal end of the the inwardly tapering edge of the fingernail pick pushing into the musician's finger.

In another preferred aspect, the present system provides a fingernail pick that has both an adhesive on its underside and a fingernail receiving slot with stabilizing material therein with the stabilizing material helping in holding the fingernail pick securely onto the end of the cantilevered portion of the musician's fingernail.

In other preferred aspects, the present system provides a fingernail pick having an arched shape (with a convex top surface and a concave bottom surface) when viewed from the front across the fingernail from the thumb-facing to pinky-facing sides of the fingernail. This shape advantageously ensures that the string contacts an edge, and not the middle, of the pick. This feature prevents the string from catching on the back of the pick. In addition, the arched shape of the underside playing surface results in a central "clearance" zone that does not touch the string, whereas the opposite underside edges of the arch act as the playing zones.

In other preferred aspects, the present system provides a fingernail pick having an underside playing surface that extends beyond that of the cantilevered portion of the musician's fingernail in both proximal and distal directions. As such, the present fingernail pick advantageously provides a larger playing surface than would be possible using only the cantilevered portion of the musician's own fingernail.

In other preferred aspects, the present system provides a fingernail pick that is tapered in thickness from a narrow or thin proximal end (adjacent to the cuticle) to a thicker distal end (adjacent to the distal end of the fingernail). The advantage of this design is that it prevents the string from catching onto the pick when the string is on the topside of the pick near the cuticle of the fingernail.

In other preferred aspects, the present system provides a fingernail pick that has a fingernail receiving slot on its underside with the slot having a pair of straight sidewalls, and a crescent-shaped distal end. The advantage of the straight sidewalls are that they can be fitted tightly against the side edges of the musician's fingernail and can resist rotational moments caused by the string being at an angle to the pick when played. The straight sidewalls of the slot also ensure that a large portion of the musician's fingernail is received into the slot. As such, the pair of straight sidewalls assist is keeping the pick securely mounted to the fingernail during playing. In other embodiments, inwardly curved sidewalls perform a similar function.

The present system also provides an optional photographic device for measuring fingernail dimensions and an optional heater for heating the adhesive to a desired temperature. Other aspects and advantages of the present novel shaped fingernail pick are presented herein.

BRIEF DESCRIPTION OF THE DRAWINGS

FIG. 8B is a sectional plan view taken along line B-B in FIG. 8A.

FIG. 8C is an alternate embodiment with the fingernail receiving slot having curved sidewalls. FIG. 8D is an alternate embodiment with the fingernail receiving slot having outwardly splayed sidewalls.

FIG. 8E is an alternate embodiment with the fingernail receiving slot having inwardly splayed sidewalls.

Figure 1:
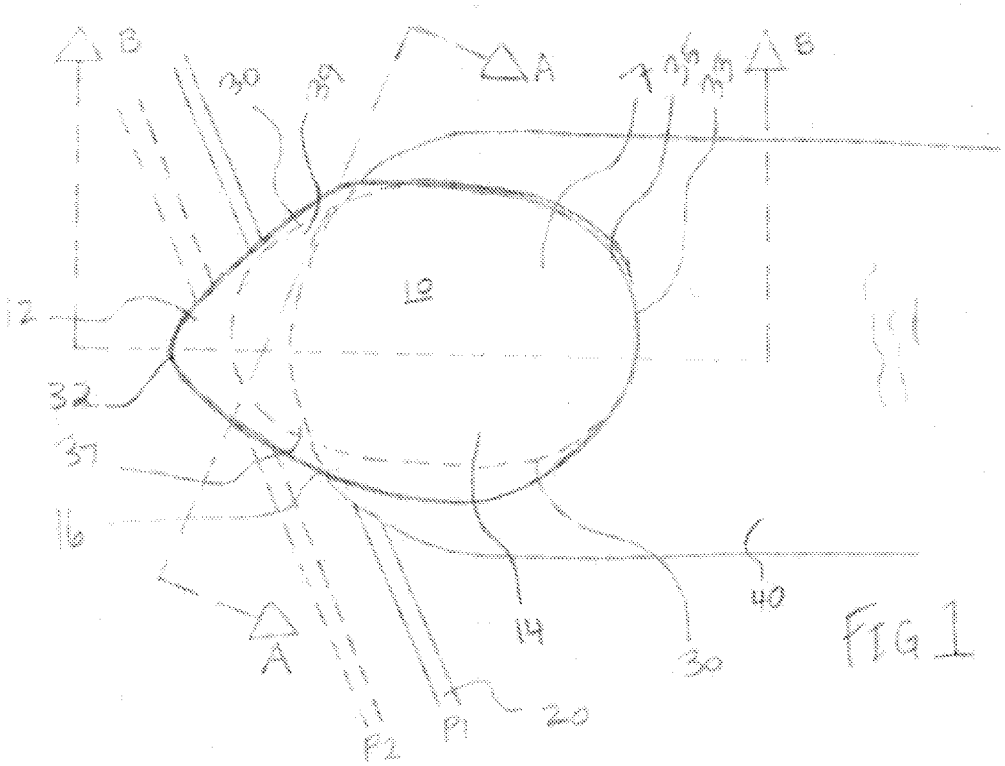
FIG. 1 is a top plan view of an embodiment of the present fingernail pick on a musician's finger.
Figure 2:
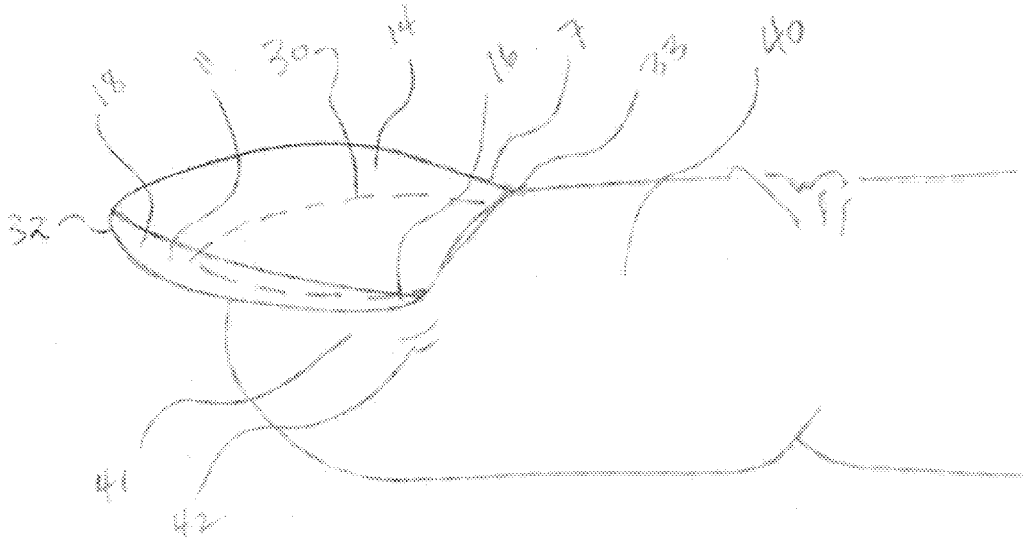
FIG. 2 is a side elevation view of the fingernail pick of FIG. 1.

DETAILED DESCRIPTION OF THE DRAWINGS (a) General Preferred Shape of the Present Fingernail Pick:

Referring now to the included figures, wherein like numerals refer to like structures, embodiments of a finger-pick, fingernail-attachable pick, prosthetic fingernail pick, artificial nail tip, or fingernail pick 10 for attachment to a fingernail 30 of a finger 40 with a fingertip 41 are shown. Stringed instruments and fingernail picks may come in many shapes and sizes and may be oriented in many different directions, and the present system specifically covers all such sizes and orientations. For the purpose of providing relative directional clarity, directions in relation to fingernail pick 10 assume that pick 10 is attached to fingernail 30 and that "bottom" or "underside" refers to the palm-side of the hand (while in an open position) and "back" or "topside" refers to the back of the hand (i.e. the opposite side of the palm). Thus, an "underside stroke" refers to activation of a string by moving pick 10 so that it contacts the string with the palm-side or underside of pick 10, and likewise, a "topside stroke" refers to activation of a string by moving pick 10 so that it contacts the string with the back-of-hand-side or topside of pick 10. And likewise, a "top view" is a view looking straight down on the back of the hand and/or straight down on the top of the fingernail pick, which is on the same side as the back of the hand when mounted properly; a "front view" is looking straight on at the pick or finger or both as if the finger is pointing at you and the top of the pick and back side of the hand are facing up; a "rear view" is the view opposite a front view looking in the pointing direction of the finger with the top of pick and back of hand facing up; and a "bottom view" is a view opposite a top view looking straight at the palm-side of the hand and/or underside of the pick. "Proximal" is understood to mean in a direction up towards the wrist whereas "distal" is understood to mean in a direction towards the end of the fingertip. The embodiments included show fingernail picks on a finger of a user's right hand, though similar, mirror-image picks are also contemplated for the left hand. It is also to be understood that the present pick may be used on one fingernail while playing an instrument or more than one fingernail at a time when playing the instrument, all keeping within the scope of the present invention. Moreover, should a musician use multiple picks at the same time, each pick may be uniquely dimensioned to match the shape of each of the musician's fingernails.

An embodiment of fingernail pick 10, as shown in FIGS. 1-11, may comprise an underside playing surface 11, a topside playing surface 12, a point or tip 32 (at the distal end of pick 10), a fingernail slot 13, an attachment or anchor portion 14 (above the nail plate of the fingernail), and an adhesive layer 15 (on the underside or bottom of pick 10). Underside playing surface 11 may comprise a thumb-side end 16 located closer to a thumb-side end 37 than a pinky-side end 39 of a cantilevered portion 31 of a musician's fingernail 30 and a tip end 18 located near tip 32. In other embodiments tip end 18 wraps substantially all the way around the underside and thus is closer to pinky-side-end 39 of fingernail 30 than shown here.

Preferably, the underside playing surface 11 is disposed substantially on the thumb-side of the fingernail pick 10 and the topside playing surface 12 is disposed substantially on the pinky-side of the fingernail pick. Advantages of this geometry include enabling fingernail pick 10 to be operated like a normal plectrum when it is being held at an angle other than 90° to the string (a technique that is commonly employed with plectrums for ergonomic reasons: it is more comfortable than always holding at 90°). In addition, when a plectrum is rotated away from this 90 degree position, then one side naturally strikes on the bottom and the other on the top. As such, by providing underside playing surface 11 is disposed substantially on the thumb-side of the fingernail pick 10 and topside playing surface 12 is disposed substantially on the pinky-side of the fingernail pick, the present design enables improved ergonomics with a pick that is adhered to the fingernail.

Figure 3:
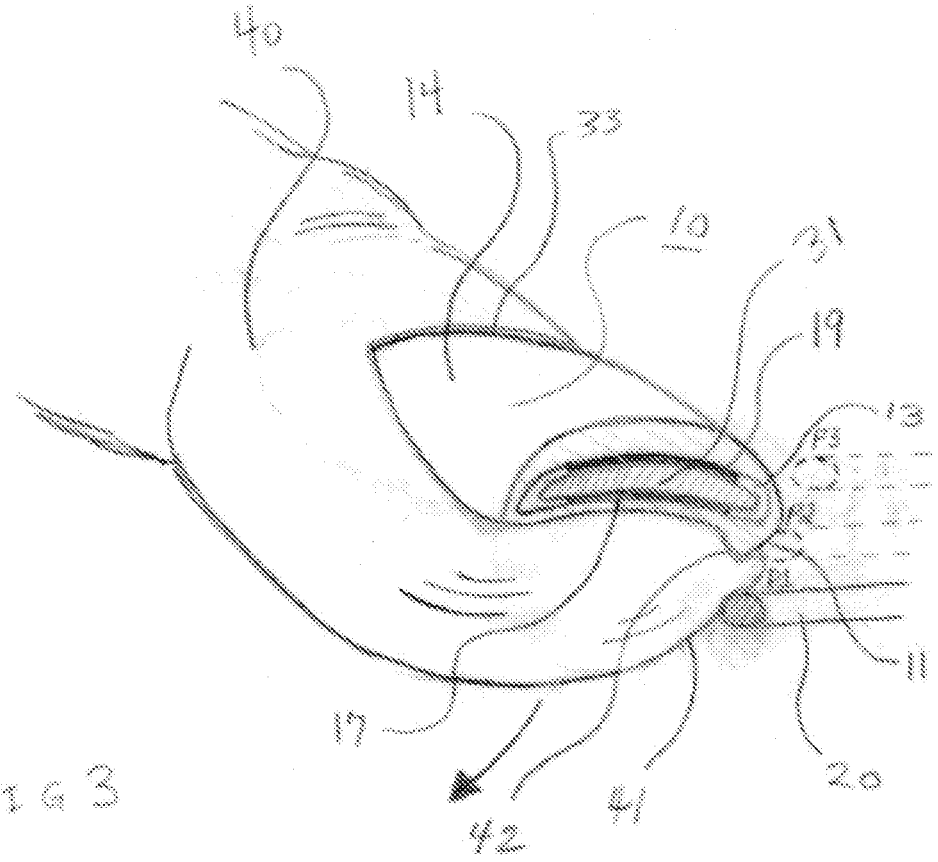
FIG. 3 is a sectional perspective view taken along line A-A in FIG. 1.
Figure 8A:
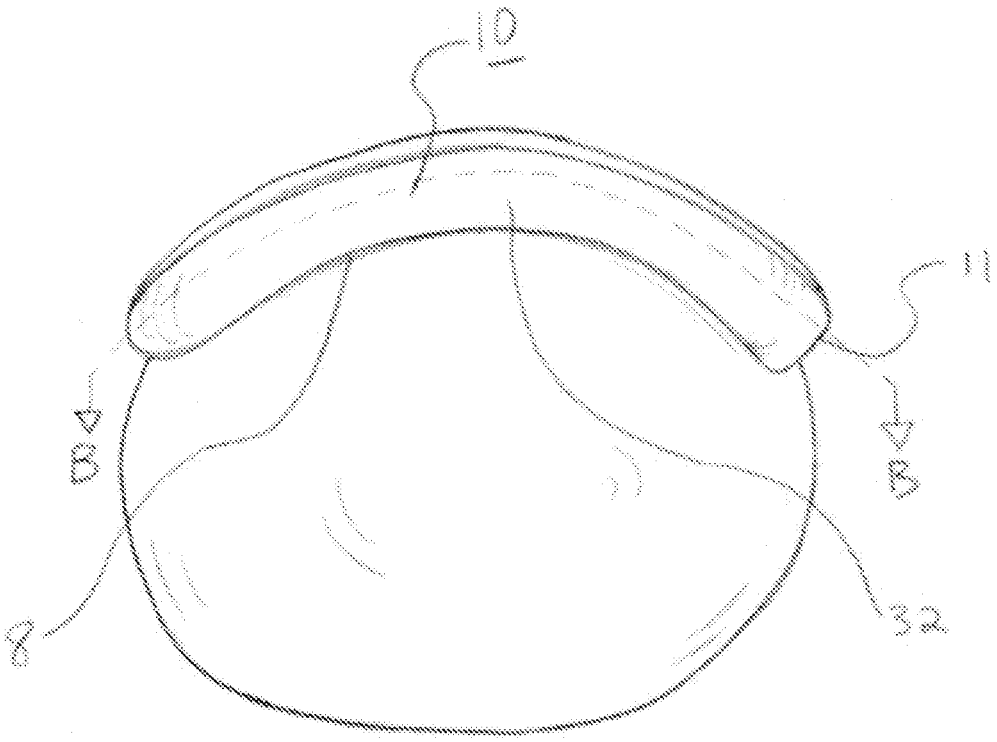
FIG. 8A is a front elevation view of the embodiment of the fingernail pick of FIG. 3.
Figure 10A:
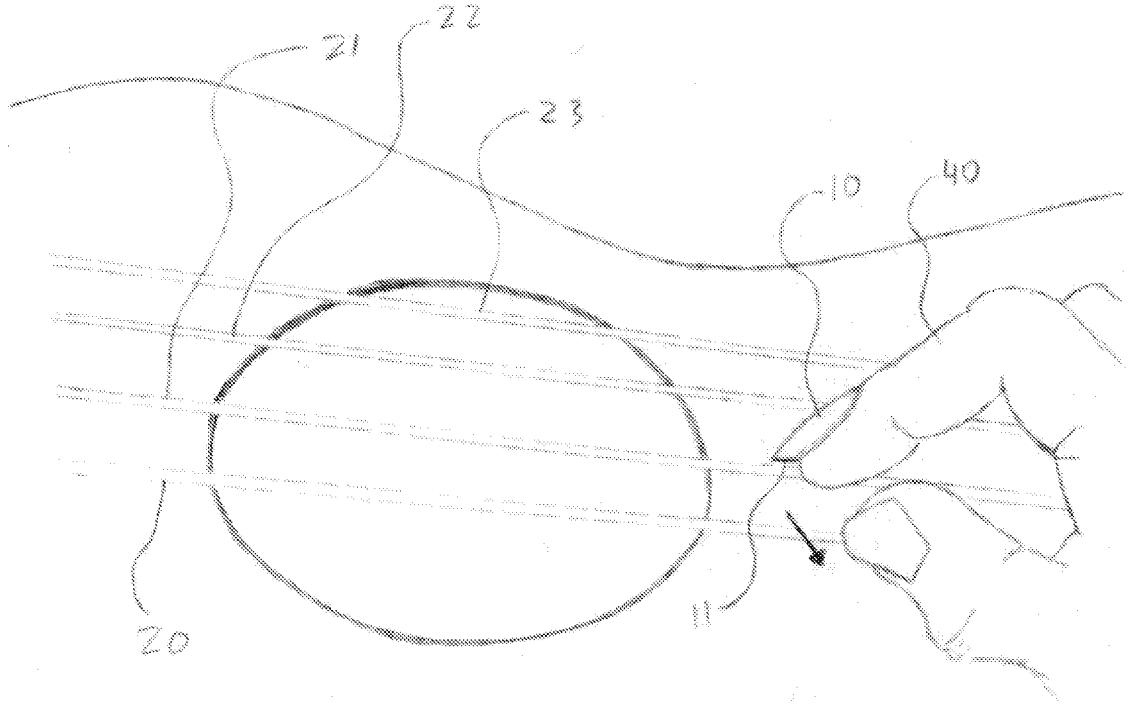
FIG. 10A is a perspective view showing a musician playing an underside stroke on a guitar.

(b) Inwardly Tapering Underside Playing Surface:

Underside playing surface 11 preferably has a novel shape which affords unique advantages. Preferably, underside playing surface 11 will be downwardly and inwardly tapered on the thumb-facing side 37 of pick 10. This tapered angle may preferably be approximately 30° to 45° as shown in FIGS. 3, 8B, and 10A (and as also shown in underside playing surface 111 in FIG. 13), though other angles are also contemplated. FIG. 8B shows clearly how underside playing surface 11 is a generally straightened, inwardly tapered portion on the thumb-facing side (i.e.: on the right side of the drawing), as opposed to the more generally curved shape on the opposite pinky-facing side (i.e.: on the left side of the drawing). As is also shown in FIG. 3 and FIG. 8A, underside playing surface 11 may be a substantially flat edge in cross section. One advantage of underside playing surface being substantially flat and downwardly and inwardly tapering is that it provides a wider and thus greater surface area of contact with string 20 (as compared to playing without pick 10, using only the musician's natural fingernail). A further advantage of underside playing surface 11 being and inwardly tapered edge is that this shape prevents the string from catching on pick 10, and instead provides a smooth transfer from the fingertip flesh onto the pick. Specifically, the proximal end of the of the inwardly tapered edge presses down into the fingertip, as seen in FIG. 3 at 42, and as explained further below. Added benefits of the inwardly tapered edge include its wider playing surface contacting the string, resulting in improved sound qualities. For example, a louder and "fatter" sound can be achieved due to lower frequencies of the string being excited. The broader area of the of the tapered edge of the underside playing surface also reduces wear on the pick by distributing the load of the string on to the pick.

(c) Length and Width of Underside Playing Surface:

Preferably, underside playing surface 11 extends further in a proximal direction than the rearmost side edge of the cantilevered portion of the musician's fingernail. Stated another way, underside playing surface 11 extends further back up towards the musician's wrist than does the edges of the musician's own fingernails. This can be seen most clearly in FIG. 5 where thumb-side end 16 of underside playing surface 11 is located closer to the musician's wrist (i.e.: in a proximal direction) than the sides of the cantilevered portion of the fingernail (which is received into the slot shown in dotted lines in FIGS. 4 and 5, the slot having a proximal end 13A). As a result, the end of the fingernail receiving slot is adjacent to the thumb-side end of the cantilevered portion of the fingernail. However, underside playing surface 11 extends further back up the side of the pick (i.e.: proximal end 16 of the underside playing surface 11 is located proximal (i.e. further up towards the wrist) than the proximal end 13A of fingernail receiving slot 13). This lengthens the playing surface of underside playing surface 11, resulting in a better tone. In addition, the underside playing surface 11 pushes into the finger so that the string can go further back up the finger without catching on the flesh of the finger.

In some embodiments underside playing surface 11 may be substantially wider (measured top to bottom across the substantially flat surface) than a guitar string diameter in order to provide a fatter, warmer, and/or improved tone when fingernail pick 10 strikes the string; while in other embodiments, underside playing surface 11 may be very thin, such as the thickness of a fingernail, in order to approximate the thinner and brighter sound of a fingernail striking a string. Optionally, underside playing surface 11 may be located below the cantilevered portion of the musician's fingernail 31 thereby allowing the underside of cantilevered portion of nail 31 to at least partially resist the force of underside strokes as will be discussed below. (As understood herein, the "cantilevered" portion of the fingernail is the portion of the fingernail that projects forward into the air with no tissue below, whereas the "nail plate" is the portion of the fingernail with the tissue of the nail bed below). In other embodiments underside playing surface 11 is located to the side of or above the cantilevered portion of nail 31.

As shown in FIG. 1, fingernail pick 10 may comprise a boomerang or partially pointed or partially triangular shape in the region where pick 10 cantilevers beyond finger 40 with tip 32 as the string-ward "point" of the triangle. In some embodiments tip 32 is actually pointed, as shown in FIG. 1, and in others tip 32 can be rounded off to the approximate shape of the payer's own cantilevered nail portion. The generally triangular-shaped region of pick 10 may approximate the shape of the tip or picking end of a conventional guitar pick or plectrum. The plectrum-like shape of pick 10 along with other structural features of fingernail pick 10, as will be discussed in more detail below, may enable pick 10 to provide similar functionality to (a) a conventional guitar pick, (b) a conventional fingerpick, and (c) a natural fingernail, while also enabling new functionality not possible with prior art devices and methods. Therefore, fingernail pick 10 may generally enable many different types of functions all in one device, greatly simplifying and improving stringed instrument performance possibilities.

Figure 4:
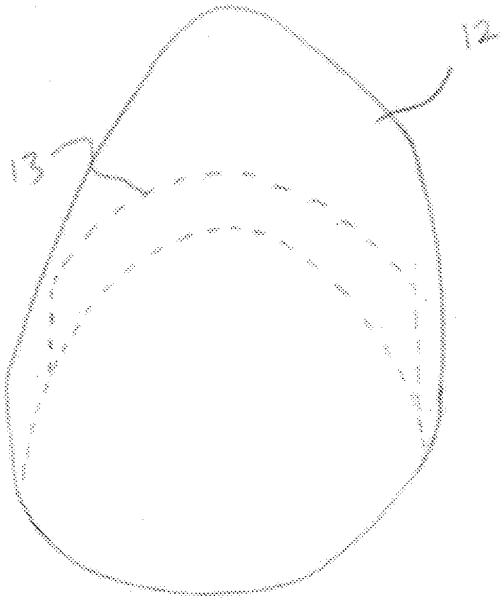
FIG. 4 is a top plan view of an embodiment of the fingernail pick (with an underside fingernail receiving slot shown in dotted lines).
Figure 5:
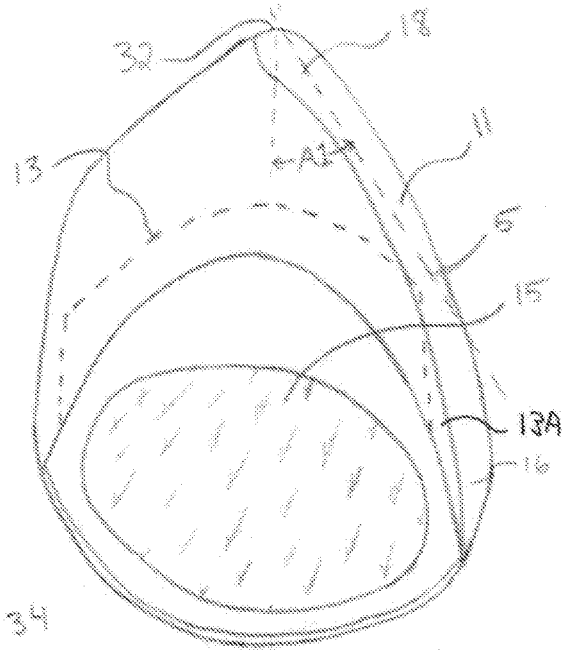
FIG. 5 is a bottom plan view of the fingernail pick of FIG. 4.
Figure 6:
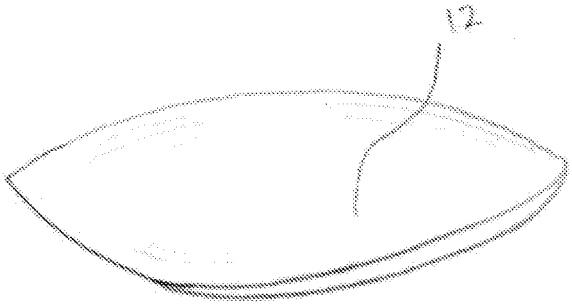
FIG. 6 is a side elevation view of the fingernail pick of FIG. 4 viewed from the pinky-side.
Figure 7:
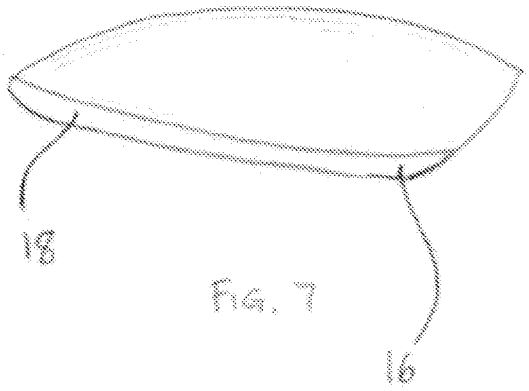
FIG. 7 is a side elevation view of the fingernail pick of FIG. 4 viewed from the thumb-side.
Figure 9:
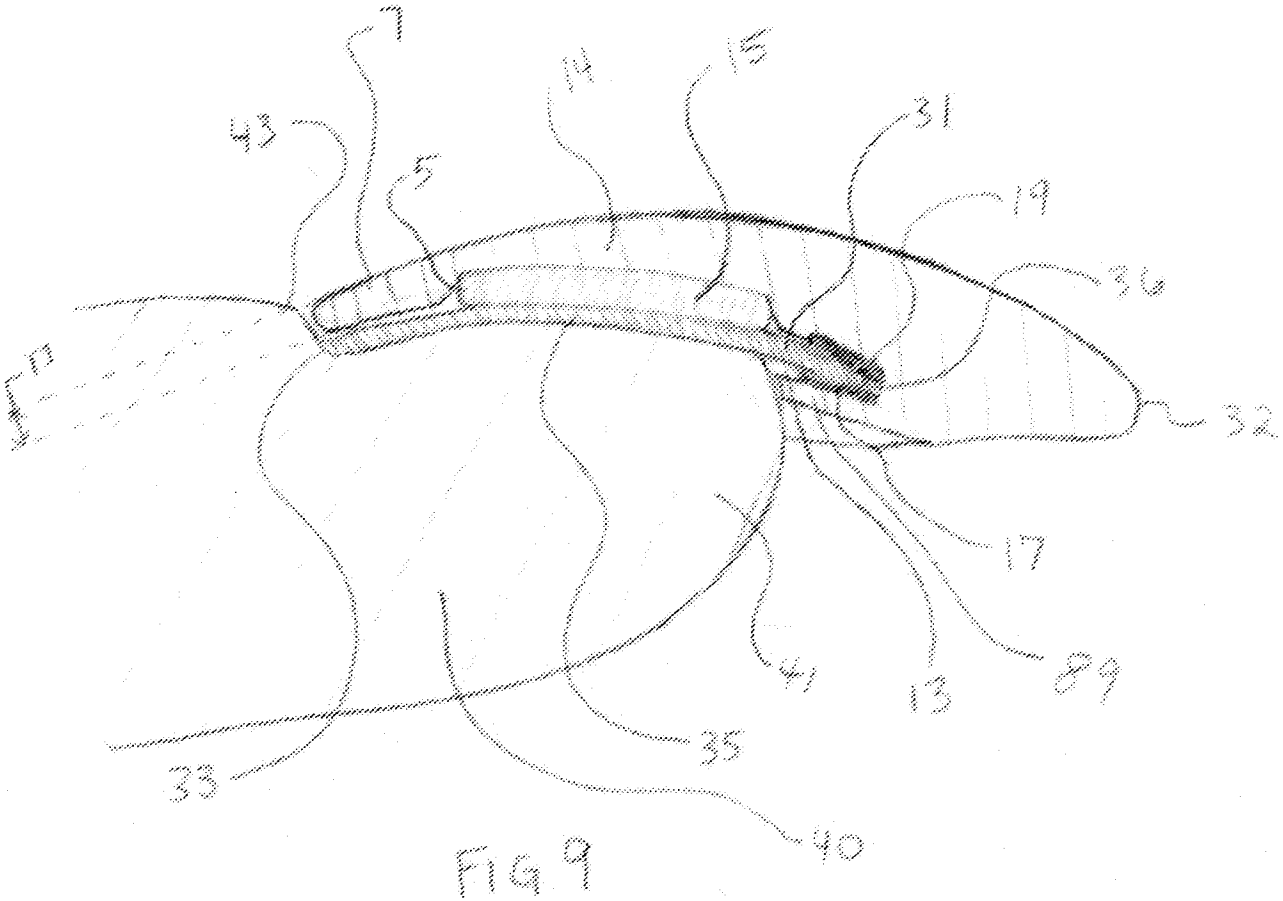
FIG. 9 is a sectional side elevation view of the fingernail pick of FIG. 3.
Figure 10B:
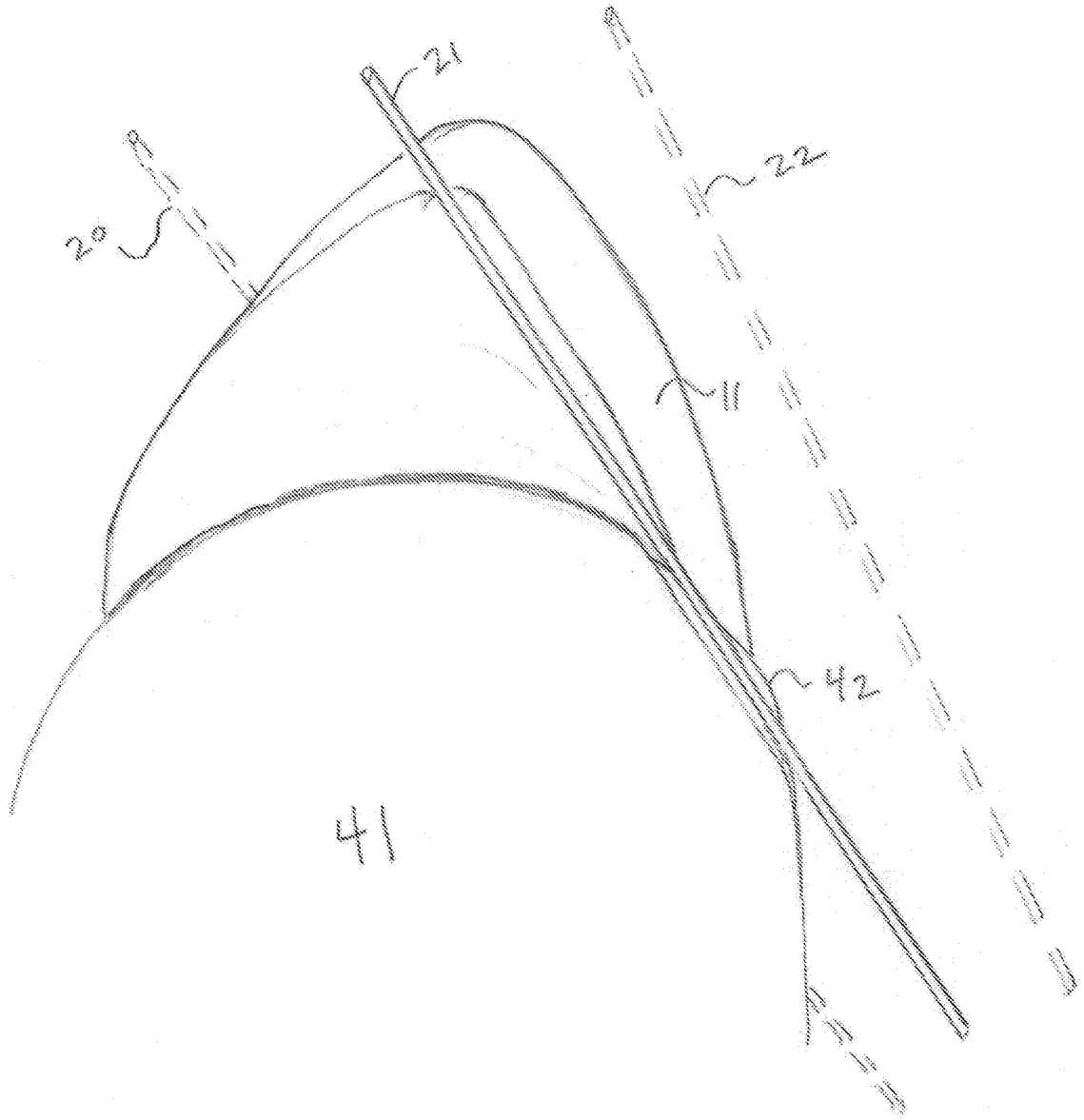
FIG. 10B is a bottom view corresponding to FIG. 10A.

(d) the Underside Plucking Stroke:

FIGS. 10A and 10B show fingernail pick 10 attached to finger 40 while finger 40 is in a typical fingerpicking/strumming hand position and ready to execute an underside plucking stroke. During this stroke, finger 40 is positioned with the sides of finger 40 at approximately a 30° to 45° angle relative to string 21, thereby approximately aligning the taper angle of underside playing surface 11 with string 21. Larger and smaller angles for A1 are also contemplated, all keeping within the scope of the present invention. An underside plucking stroke is executed by moving the distal phalanx of finger 40 from the position shown in FIG. 10A toward the base of finger 40 in the direction of the arrow as underside playing surface 11 slides along string 21 until tip 32 slides off string 21 initiating the activation of string 21. The approximate alignment of the taper angle of underside playing surface 11 and string 21 (as seen where tapered underside playing surface 11 contacts string 21 in FIG. 10A) allows substantially the full width of underside playing surface 11 to slide along string 21 as string 21 is activated. The embodiment of FIGS. 1-11 shows an underside playing surface 11 with a top-to-bottom width near the middle of approximately 0.050" to 0.100", measured parallel to the substantially flat surface of playing surface 11. Such a width may provide distinct advantages over fingernails and other fingerpicks (which are substantially thinner) since the extra width, when striking string 21 with string 21 approximately parallel to the substantially flat surface of playing surface 11, may serve to (a) "fatten" the tone (i.e. increase the volume of deeper harmonics in the note), (b) increase the volume of the string once activated, and (c) slow down the natural wear on playing surface 11 by spreading the impact force of string 21 on playing surface 11 over a wider area. Additional advantages of pick 10 during an underside plucking stroke may be provided by the angle A1 of underside playing surface 11 relative to centerline 34, as shown in FIG. 5. Angle A1 may be approximately 30° to 60° and may be large enough to provide a long enough playing surface for easy striking of the string and shallow enough to provide a smooth lead-in from underside playing surface 11 to tip 32 during string activation.

(e) Underside Strumming Stroke:

The fingerpicking/strumming hand position of FIGS. 10A and 10B may also be the same starting point for an underside strumming stroke. However, instead of flexing the distal phalanx as discussed above, an underside strumming stroke with fingernail pick 10 is executed by moving the whole hand such that pick 10 moves in a direction approximately perpendicular to string 20 and parallel to a plane defined by the top surfaces of string 20 and adjacent string 21. Since strums may frequently involve strumming across more than one string, pick 10 may typically initiate an underside strumming stroke from a position beyond string 23 (with finger 40 at a similar angle and orientation as shown in FIGS. 10A and 10B), then strum across string 23, 22, 21, 20 (in that order). The width, taper angle, and angle A1 of the underside playing surface 11 may provide the same benefits during an underside strumming stroke as an underside plucking stroke, except just applied to multiple strings.

(f) Topside Flicking Stroke:

A topside flicking stroke to activate a single string, such as string 22, may start in the same position as shown in FIGS. 10A and 10B. Instead of flexing the distal phalanx inward, the distal phalanx may be flicked in an outward direction away from the palm and toward string 22. String activation happens when topside playing surface 12 slides across string 22 until tip 32 moves beyond string 22. Topside playing surface 12 is specially shaped to allow string 22 to contact, become activated, and then slide off of pick 10 without getting hung up or catching on protruding surfaces of pick 10. Preferably, pick 10 may be dimensioned to be thin at the rear edge along the cuticle in such a way to ensure that pick does not catch on the strings here, as will be discussed in more detail below. Topside playing surface 12 also leaves tip 32 at a similar angle as underside playing surface 11, thereby forming a plectrum-like point which is ideal for strumming. In some embodiments, as seen in FIG. 1 and FIG. 4, playing surface 12 leaves tip 32 at a slightly wider angle than playing surface 11. This arrangement increases the total swept angle from underside playing surface 11 to topside playing surface 12, ensuring that the tip 32 is not too pointed to play quickly while staying within the maximum allowable width before the playing surface 12 interferes with playing surface 11 on an adjacent finger, or interferes with the side of the adjacent finger.

(g) Topside Strumming Stroke:

A topside strumming stroke may be similar to a topside flicking stroke except that several or all strings are activated by moving the whole hand in a direction opposite the arrow in FIG. 10A such that pick 10 glides smoothly over several or all of strings 20, 21, 22, 23. The wider angle of topside playing surface 12 (compared to underside playing surface 11) is especially useful during the topside strumming stroke since this is the stroke most commonly used for the hardest and loudest stroke, for example when the musician wants to emphasize a chord by strumming very loudly. The wider angle of playing surface 12 results in a better lead-in as the surface contacts the strings, thus reducing drag across the strings.

(h) Side Stroke:

In addition to the underside and topside strokes discussed above, fingernail pick 10 may, for example, enable a musician to perform rapid alternating side strokes while fingernail pick 10 is connected to a finger, such as an index finger, as may be required to execute a fast passage of music involving multiple notes played in rapid succession on the same string. When such a passage is performed with a conventional plectrum, the musician typically squeezes the plectrum, which is a flat, plate-like device, between two or three fingertips so that the plane of the flat side of the plectrum is approximately perpendicular to the string and a "point" of the triangle is used to contact the string. This technique requires a firm grip on the plectrum so that the musician does not drop the plectrum during performance. Some guitarists, however, still frequently drop picks, and thus have to bring multiple backup picks to a performance. Fingernail pick 10 may solve this problem since pick 10 is secured to finger 40 on its own (without requiring squeezing between fingers). Other guitarists develop tendonitis and other health-related issues due to squeezing the pick during performance; thus we contemplate that fingernail pick 10 may also help reduce such risks since no squeezing is required.

Figure 11A:
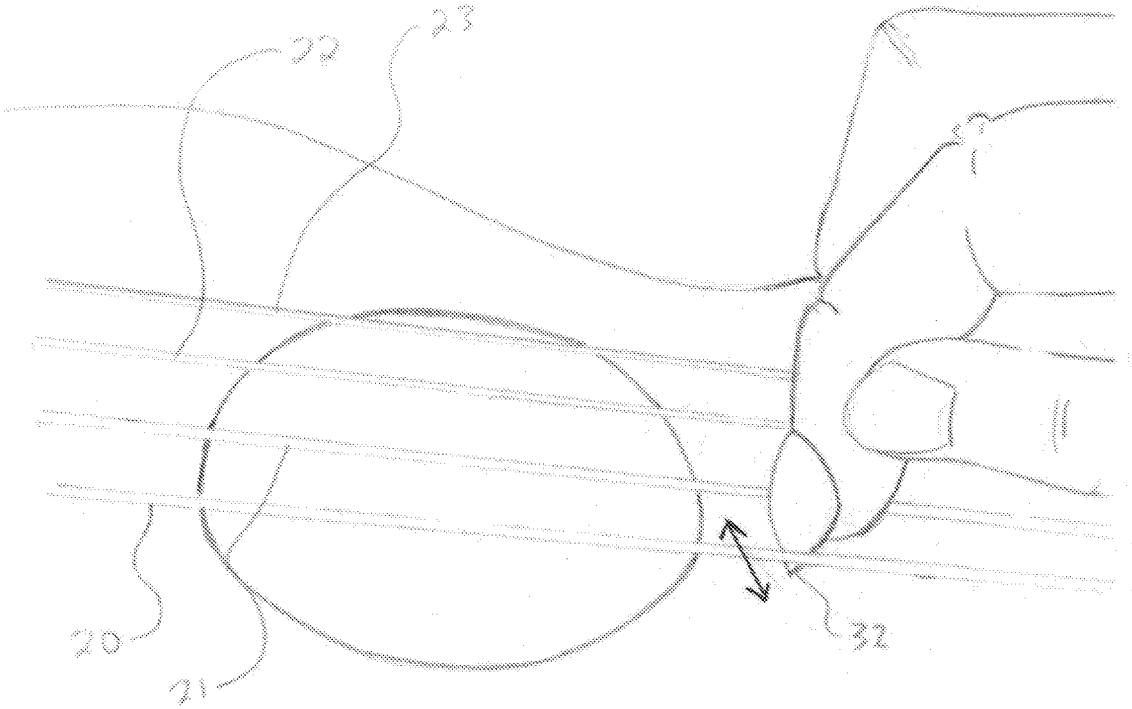
FIG. 11A is a perspective view showing a musician playing a topside stroke on a guitar.
Figure 11B:
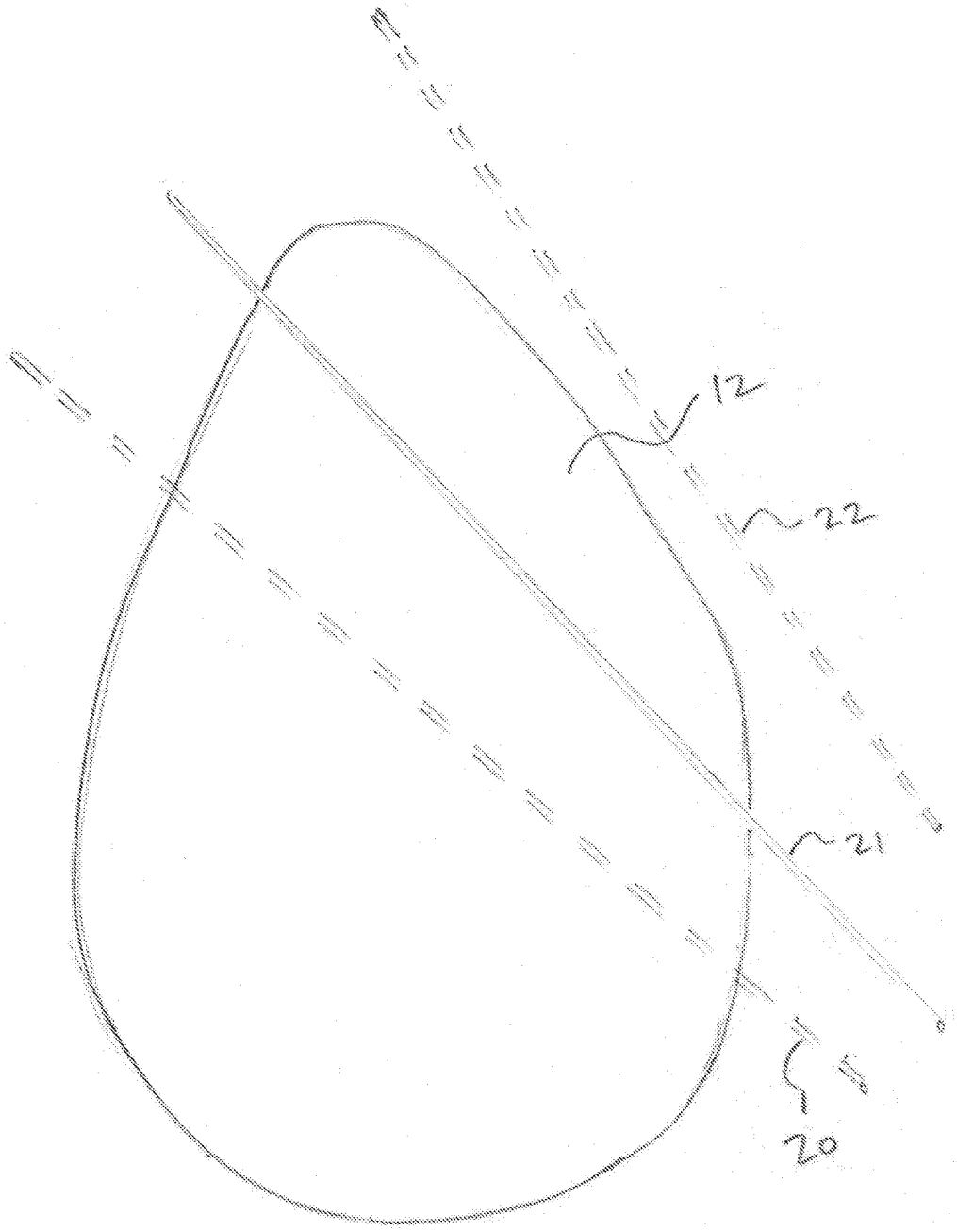
FIG. 11B is a top plan view corresponding to FIG. 11A.

FIGS. 11A and 11B show fingernail pick 10 and finger 40 in the process of activating string 20 by executing multiple, rapid side strokes. As shown, a side stroke hand position is assumed by positioning the distal phalanx of finger 40 approximately perpendicular to string 20 with tip 32 below and adjacent to string 20. Finger 40 is rotated approximately 45° from the fingerpicking/strumming hand position discussed above, such that the thumb-side of finger 40 faces a direction approximately perpendicular to string 20. As demonstrated by FIGS. 10A to 11B, fingernail picks 10 enable a side stroke hand position that is only slightly different than the fingerpicking/strumming hand position and is thus easy to quickly move back and forth between the two positions. To execute side strokes, finger 40 is rapidly moved back and forth perpendicularly relative to string 20 (in the direction of the arrows in FIG. 11) such that the two opposite sides of pick 10 (one facing you and the other facing away from you in FIG. 11A) alternately strike string 20. Finger 40 may be supported by the thumb as shown to help stabilize finger 40 as it strikes string 20, effectively adding to the power and precision with which finger 40 activates string 20.

(i) Advantages of Fingerpick not being Held Between the Fingers:

As shown in FIG. 11A, pick 10 is not held or squeezed by the fingers, and thus is not at risk of being dropped. The reliable, fixed location of pick 10 relative to finger 40 also helps to improve the accuracy and increase maximum achievable speed of side strokes since the musician always knows exactly where pick 10 is located. These features are in contrast to conventional plectrums which are not connected to the finger and thus do not have a reliable position relative to a finger. While some musicians gain some of the reliability benefits of pick 10 by using a conventional thumbpick (which is attached to the thumb) for rapid side strokes, such a technique comes with drawbacks such as (a) it is not possible to simultaneously activate a lower string, such as for a bass line, while executing a side stroke on a higher string with a thumbpick (since the pick cannot be in two places at once) and (b) use of the thumb on the high strings results in a greater distance between standard underside stroke hand position and side stroke hand position than that of the instant invention (as shown in FIGS. 10-11). Fingernail pick 10 may provide the further advantage that it feels very natural to the musician since it is only slightly larger than and is mounted directly to the fingernail, instead of being a separate piece of gear that you have to hold or wrap around your finger.

(j) Fingernail Pick Deformation of Fingertip:

With specific reference to FIGS. 1-3 and 10B, where FIG. 1 shows a top view of fingernail pick 10 and FIG. 3 shows a section cut as indicated at A-A in FIG. 1, underside playing surface 11 may project into and slightly deform the fingertip 41 (relative to a natural shape of fingertip 41) at the proximal end of the inwardly tapered edge when attached to fingernail 30, as shown at 42. Such deformation at 42 may result in significant benefits relative to prior art fingerpicks since string 20, such as during an underside stroke, may smoothly transition from a position P1 to position P2 and further to position P3 (relative to finger 40 as finger 40 moves in the direction of the arrow as shown in FIG. 3) without getting temporarily hung up or unnaturally catching on fingernail pick 10. At some positions during an aggressive underside stroke string 20, string 20 may press into and deform finger 40 before string 20 contacts underside playing surface 11 of fingernail pick 10. In such a case, the inwardly tapered shape of underside playing surface 11 of fingernail pick 10 may provide a significant advantage since underside playing surface 11 would project into finger 40 thereby providing a playing surface for string 20 when it is pushing into finger 40 at the point where finger 40 meets playing surface 11. Without a playing surface projecting into finger 40, string 20 could get hung up when transitioning from a position where it is only in contact with finger 40 to a position where it is at least partially contacting fingernail pick 10. For example, if string 20 presses into finger 40 by 1 mm, then a 1 mm pressing in of playing surface 11 ensures that string 20 will hit playing surface 11 when transitioning from flesh to pick 10. Thus, fingernail pick 10 provides a means for enabling a smooth transition as string 20 moves from finger 40 to pick 10 during an underside stroke.

In addition, the proximal end of the inwardly tapered playing surface pushing into the musician's fingertip also presents a broader contact area (i.e.: the area across the inwardly tapered surface 11) to the string than would be the case of the narrower musician's fingernail used without the present pick 10. As a result, lower frequencies of the string can be excited, resulting in louder and "fatter" tones.

(k) Tapered Proximal End and Adhesive Layer Recess:

With specific reference to FIGS. 5 & 9, anchor portion 14 may comprise a tapered-down thin portion 7 (at rear edge 33, near the cuticle of the musician's finger 40) and adhesive layer 15 may be located in an underside recess 5. Adhesive layer 15 may comprise a thickness that is approximately twice a depth of recess 5, such that adhesive layer 15 is at least partially sunken into the underside of anchor portion 14; thereby reducing a total thickness Ti of anchor portion 14 near the rear edge 33 of the non-cantilevered portion, or nail plate 35, of fingernail 30. In some embodiments the tapering down at thin portion 7 and/or the sinking of adhesive layer 15 up into recess 5 may enable anchor portion thickness Ti to be less than or equal to, or only slightly higher than, a height of the skin of finger 40 at 43. This novel feature thereby reduces or prevents situations where string 20 catches or gets hung up on fingernail pick 10 during a topside stroke. For example, during a topside stroke, string 20 may initially contact finger 40 near 43 (but to the left of 43 as shown in FIG. 9) prior to contacting fingernail pick 10. Then, as finger 40 moves relative to string 20 (effectively to the left in FIG. 9), string 20 may slide along finger 40 until it transitions to sliding along the topside of anchor portion 14, eventually sliding off topside playing surface 12 as string 20 is activated. Clearly, if, during such a topside stroke, anchor portion 14 had a significant bump, trough, gap, or other impediment to smooth sliding of string 20 through the topside stroke process as described, then string 20 may not be properly activated, or the impediment may make activation much more difficult. Thus, the countersinking of adhesive layer 15 and the tapering-down of the thin portion 7 of anchor portion 14 may significantly improve the string activation process of fingernail pick 10 during a topside stroke. As can also be seen, recess 5 need not extend fully back (in the proximal direction) into tapered thin region 7. As a result, adhesive 15 need not cover the entire nail plate of the musician.

In other embodiments there is no recess 5, but instead the total thickness of adhesive layer 15 and thin portion 7 combined is still less than, or substantially similar to, the height at 43, thereby allowing the smooth sliding of string 20 without requiring the countersinking of adhesive layer 15. In still other embodiments a portion of anchor portion 14 that adhesive layer 15 is adhered to may be textured and/or comprise grooves to strengthen the bond between adhesive layer 15 and anchor portion 14. In further embodiments adhesive layer 15 is surrounded by a void, cavity, or hollow space to allow room for expansion when adhesive is pressed onto fingernail 30.

The combination of fingernail pick 10 having a thin tapered region 7 at the cuticle and a thick tip at the distal end of the cantilevered fingernail portion provides advantages both in terms of providing a desired fat, loud sound and also in preventing the string from catching on the top surface of the fingernail pick.

(l) Downwardly Arching Sides of Fingernail Pick:

With specific reference to FIG. 8A, which shows a perspective view from the front of fingernail pick 10 attached to fingernail 40, fingernail pick 10 may further comprise a downwardly curved or downwardly arching bottom portion 8 beneath cantilevered nail portion 31 (FIG. 8B) that forms a concave hollow, cavity, depression, or recess underneath the center of the pick. Stated another way, pick 10 is curved such that the opposite side edges of pick 10 are lower than the center portion of pick 10. Thus, the strings contact the opposite sides of the downwardly arched portion 8, while a central "clearance" zone is formed underneath the middle of the pick that does not touch the string. Downwardly arching portion 8 may provide significant benefits since it may force string 20 to contact an underside edge, such as underside playing surface 11, or a similar location on the opposite sides of the underside, during an underside stroke, instead of contacting a middle region beneath fingernail receiving slot 13. Downwardly arching portion 8 may help to ensure that string 20 does not catch on another portion of the underside of fingernail pick 10 and further that the portion of fingernail pick 10 that is intended for activation during underside strokes, (i.e.: underside playing surface 11), is the principle portion of pick 10 that activates string 20 during an underside stroke. Furthermore, the distal portion of arching portion 8 forms the bottom 89 of slot 13, as will be discussed in more detail below.

When viewed from the front as in FIG. 8A, the top surface of the pick is convex and the bottom surface of the pick is concave. Stated another way, the top surface of the pick is highest at the center and the bottom surface of the pick is lowest at the edges.

(m) Stabilizing Material in Addition to Adhesive:

As explicitly shown in FIGS. 3 & 9, slot 13 may further comprise an upper stabilizing material 19 and lower stabilizing material 17 for helping to stabilize pick 10 during string activation. The upper stabilizing material 19 is positioned above the end of the fingernail and the lower stabilizing material 17 is positioned below the end of the fingernail. In some embodiments stabilizing material 17, 19 may allow fingernail 30 to at least partially deform or displace stabilizing material 17, 19 when pick 10 is being attached to fingernail 30. This way slot 13 may not have to be sized to tightly fit the cantilevered portion 31 of the fingernail, potentially allowing for a more universal design and/or less discrete sizes required to fit a variety of different sizes and shapes of fingernails. Stabilizing material 17, 19 may optionally have a clay-like consistency, a highly flexible rubber-like consistency, and/or may comprise means to increase friction between cantilevered nail portion 31 and slot 13, thereby helping to stabilize pick 10. In some embodiments stabilizing material may be used on the top of slot 13 only and in other embodiments stabilizing material may be used on the bottom of slot 13 only. In other embodiments there is no stabilizing material. Further embodiments comprise stabilizing material in a ridged shape, whereas other embodiments comprise stabilizing material running substantially the full width of slot 13.

(n) Straight or Curved Sidewalls of Fingernail Receiving Slot:

FIG. 8B shows a section view cut along line B-B in FIG. 8A. The section view cut is drawn following yet just above fingernail 30 thereby effectively removing the top of pick 10 and revealing the cantilevered portion 31 of the musician's fingernail resting on top of the bottom of slot 13 with edge of slot 26 shown is dashed line since it is under cantilevered nail portion 31. Straight sidewalls 28, 29 of fingernail receiving slot 31 are shown directly adjacent to the straight edges 48, 49 of cantilevered nail portion 31. While a small gap is depicted between sidewalls 28, 29 and edges 48, 49 for clarity in the drawing, in many embodiments pick 10 is sized so that there is little or no gap here. The perpendicular distance between sidewalls 28, 29 is referred to as the width of slot 13 and it may be desirable for mechanical reasons to substantially match this width to the width of cantilevered nail 31, which is measured as the perpendicular distance between edges 48, 49. The mechanical reason is as follows. When pick 10 strikes a string, a moment is imparted to pick 10 and the sidewalls help to resist that moment. For example, if pick 10 is moved effectively to the right in FIG. 8B such that topside playing surface 12 strikes a string, then a counterclockwise moment is imparted to pick 10. If there is a large gap between fingernail edges 48, 49 and fingernail receiving slot sidewalls 28, 29, then the adhesive layer 15 and any friction between the top and bottom of cantilevered nail 31 and slot 13 will likely be relied upon to attempt to resist the load. In some embodiments the slot friction and adhesive do provide enough resistance to such loads to ensure that pick 10 stays secured to fingernail 30.

In other embodiments, where for example it may be desired to lower slot friction and reduce adhesion of the adhesive (for ease of installation and removal), having little or no gap between sidewalls 28, 29 and edges 48, 49 may provide the principle means of resistance to the counterclockwise force of the string. And this resistance can be quite strong given that sidewalls 28, 29 provide a hard stop. In some embodiments the width between sidewalls 28, 29 is slightly less than the width between edges 48, 49 resulting in a press-fit action to squeeze edges 48, 49 of the fingernail between sidewalls 28, 29, thus further tightening the fit and increasing resistance to string forces.

FIG. 8B further reveals the substantially crescent-like shape of both cantilevered fingernail 31 and slot 13 when viewed from the top. The crescent shape is slightly altered to add straight sidewalls 28, 29 to the slot 13. Many humans typically cut or file their nails to have this crescent shape with straight edges near the ends. It may be due to the fact that the nail grows out relatively straight from the ends. The fingernail receiving slot has slot ends 51, 52 and cantilevered nail 31 has fingernail ends 61, 62. FIG. 8A further reveals that while slot 13 and nail 31 are substantially crescent-shaped when viewed from the top they are also arched when viewed from the front.

FIG. 8C shows an embodiment having inwardly curved sidewalls which gently push against the sides of the cantilevered portion of the fingernail. FIG. 8D shows an embodiment where the sidewalls are straight, but splay outwardly to accommodate a musician having a fingernail in this shape. Conversely, FIG. 8E shows an embodiment where the sidewalls are straight, but splay inwardly to accommodate a musician having a fingernail in this shape.

As will be discussed in more detail below, picks 10 may be manufactured in various sizes or custom fitted to a user's fingernail. FIG. 8B shows slot ends 51, 52 slightly offset from fingernail ends 61, 62. It is clear from the drawing that the length of and width between sidewalls 28, 29 and the length of and width between edges 48, 49 may be closely matched for a good fit of pick 10 onto cantilevered nail 31. Since the nail 31 typically changes in length over time (as it grows out and is cut or filed), we further contemplate providing some extra room at the forward end of slot 31, essentially enough to accommodate the longest anticipated cantilevered nail length. FIG. 8B also reveals how the curvature of slot edge 26 may be matched to the curvature of the base of cantilevered nail 38 right where the nail begins to cantilever.

(o) Ends of Fingernail Receiving Slot Proximal to Cantilevered Portion of Nail:

FIG. 8B further reveals that slot ends 51, 52 are positioned further in a proximal direction than the distal end 36 of cantilevered nail portion 31. This proximal displacement provides a distinct advantage during topside strokes. As clearly shown in FIG. 9, a topside stroke that effectively pushes down on the tip 32 creates a moment about the tip of cantilevered nail 36, effectively creating a clockwise (in FIG. 9) rotational force for pick 10 about tip 36. In the absence of adhesive layer 15, slot ends 51, 52 may provide the strongest resistive moment against the force since these two points are the proximally furthest underside points from the center of rotation, although it is clear that the entire bottom 89 of slot 13 may provide resistance. In some embodiments adhesive layer 15 can be eliminated in favor of solely relying on the resistive capacity of fingernail receiving slot 13, and in particular slot ends 51, 52, for resisting the rotational forces as described for topside strokes. In the embodiment of FIGS. 1-11, where adhesive layer 15 is present, slot ends 51, 52 still provide benefits since less work is required from the adhesive resulting in the possibility of reducing the holding power of the adhesive and thus making it easier to install and remove pick 10. Even in cases where there is no cantilevered nail portion or the cantilevered nail portion is too flexible to provide much support, slot ends 51, 52 still provide resistive benefit since the center of rotation is now effectively moved proximally to the tip of the nail plate, which is still distal relative to slot ends 51, 52 (which means that slot ends 51, 52 still provide a resistive moment, just less).

While the crescent-shaped bottom 89 of slot 13 provides mechanical benefits as discussed during topside strokes, the present innovative shape also provides benefits during underside strokes since the center of rotation moves to the rear edge of the anchor portion and there is significant resistive moment from all portions of the bottom 89 of slot 13 to resist the counterclockwise (in FIG. 9) rotational force, with the maximum resistive moment from slot 13 coming from tip 36. Thus, it is clear that the bottom 89 of crescent-shaped slot 13 provides resistance to both topside and underside strokes. And, as noted above, the bottom 89 is also arched when viewed from the front as in FIG. 8A. This arching provides further benefit since it allows the bottom 89 to more accurately match the naturally arched underside of cantilevered fingernail 31, thereby enabling the slot ends 51, 52 to be located proximally closer to nail ends 61, 62 than would otherwise be possible (since bottom 89 would run into cantilevered nail portion 31 or fingertip if the curvature of the arch does not substantially match). And the closer slot ends 51, 52 are to nail ends 61, 62 the great the resistive moment during topside strokes as discussed above.

Figure 12:
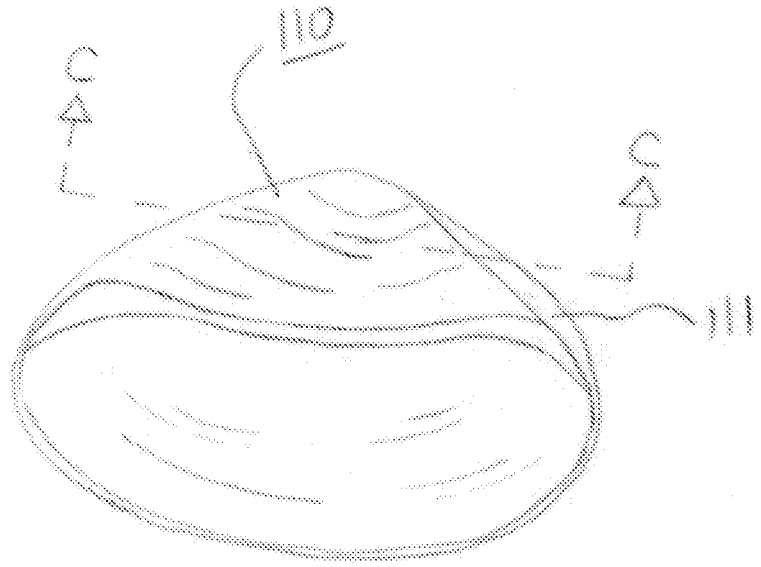
FIG. 12 is a bottom perspective view of an embodiment of the fingernail pick.
Figure 13:
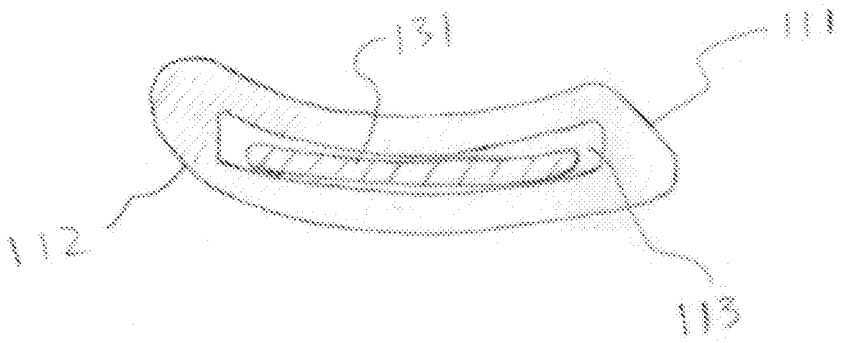
FIG. 13 is a sectional elevation view of the fingernail pick of FIG. 12 taken along line C-C showing the curvature of the fingernail receiving slot.

(p) Fingernail Receiving Slot Curved Down at Side Edges:

FIGS. 12-13 show an embodiment of a fingernail pick 110 that has a fingernail slot 113 that is shaped for a tight fit of cantilevered nail portion 131 into slot 113. FIG. 12 is a rear perspective showing fingernail pick 110 upside down with the underside facing up. FIG. 13 is a section cut along line C-C as shown in FIG. 12, with the addition of cantilevered fingernail portion 131 (finger and fingernail 131 are not shown in FIG. 12). Underside playing surface 111 is similar to underside playing surface 11 discussed above. Slot 113 is formed by first measuring the approximate radius of curvature of fingernail 131 and then intentionally forming the slot with a slightly lower radius of curvature in order to tighten slot 113 relative to fingernail 131 and increase friction between slot 113 and nail 131, which in turn results in fingernail pick 110 being held more tightly onto fingernail 131. This tightening is evident in FIG. 13 as the lower center and upper outer portions of nail 131 are touching, and being slightly deformed by, slot 113. In some embodiments this tightening effect is more pronounced such that slot 113 causes more deformation of fingernail 131 than shown in FIG. 13. The exact amount of deformation can be user selected by increasing or decreasing the radius of curvature of slot 113, which is a beneficial feature since human fingernails vary in terms of how flexible they are. A stiffer nail requires less deformation for the same amount of increase in friction as a more flexible nail. Therefore, in other embodiments, the radius of curvature of slot 113 is slightly greater than the radius of curvature of fingernail 131, thereby resulting in the same tightening effect in reverse, (i.e. the top center of fingernail 131 contacting the top of slot 113 and the lower side edges of fingernail 131 contacting the bottom of slot 113).

Figure 14:
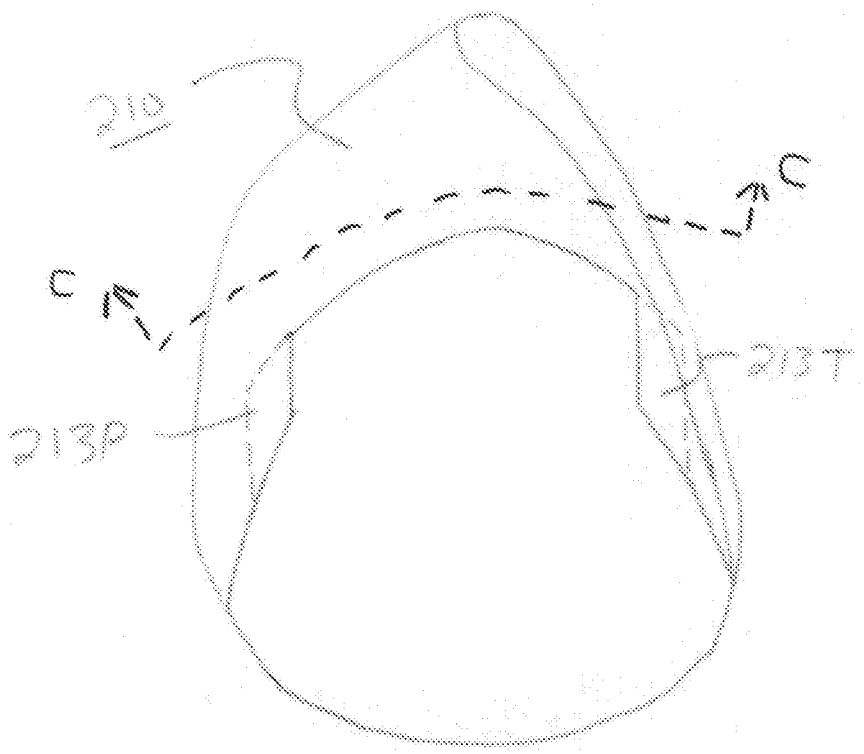
FIG. 14 is a bottom plan view of an embodiment of the fingernail pick having separate thumb-side and pinky-side fingernail receiving slots.

(q) Separate Thumb and Pinky Side Bottom Slots:

FIG. 14 shows a bottom view of an embodiment of a fingernail pick that is similar to the embodiment of FIGS. 1-11 except that the slot has been mostly removed. Instead, all that remains is thumb-side slot 213T and pinky-side slot 213P on either side. Each of these slots is adapted to function in a similar way to slot 13, except the removal of the middle slot portion may allow a wider range of nail sizes to fit the same size pick 210 since variance of the cantilevered nail in the middle region won't interfere with the slot. In other embodiments similar to pick 210, slots 213T, 213P are reduced to an even smaller size than shown in FIG. 14 such that cantilevered nail is no longer inserted longitudinally, but rather may be snapped into the slot vertically; the pick is held with the anchor portion is alignment with nail plate, then pressed straight down and snapped into place. An advantage of such embodiments is that additional adhesive may now be easily utilized along the whole length of the underside such that the adhesive touches the top of the cantilevered portion of nail in addition to the nail plate.

Figure 15A:
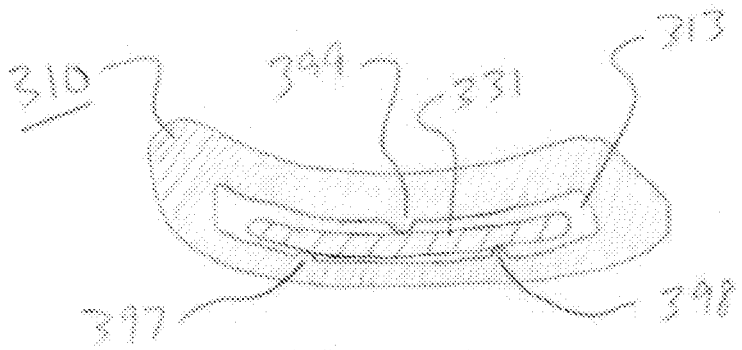
FIG. 15A is a sectional elevation view of the fingernail pick of FIG. 14 taken along line C-C showing longitudinal ridges in the fingernail receiving slot.

(r) Longitudinal Stiffening Ribs in Fingernail Receiving Slot:

FIG. 15A shows a cross section view of a pick 310 that is similar to pick 110 except that longitudinal ribs have been added to the inside of slot 313 to increase friction and help secure pick 310 to fingernail 331. In other embodiments a rib is included just outside of the slot running laterally on the anchor portion for the purpose of creating a pivot: the cantilevered nail is inserted into the slot at an angle, it then pivots over rib and gets locked down by the adhesive.

Figure 15B:
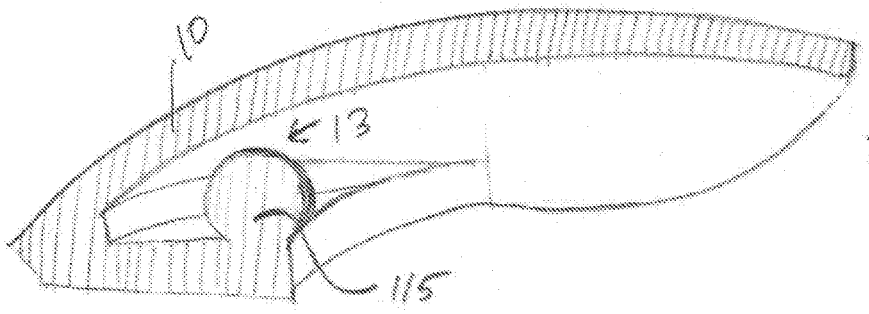
FIG. 15B is a sectional view of an alternate embodiment of the fingernail pick.
Figure 15C:
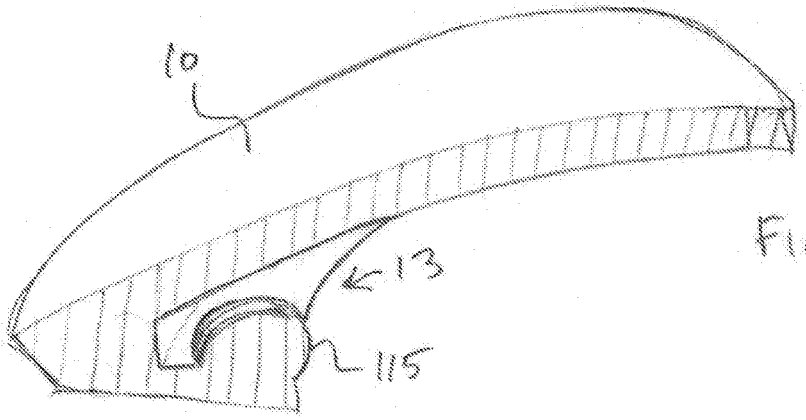
FIG. 15C is a slightly rotated view corresponding to FIG. 15B.
Figure 15D:
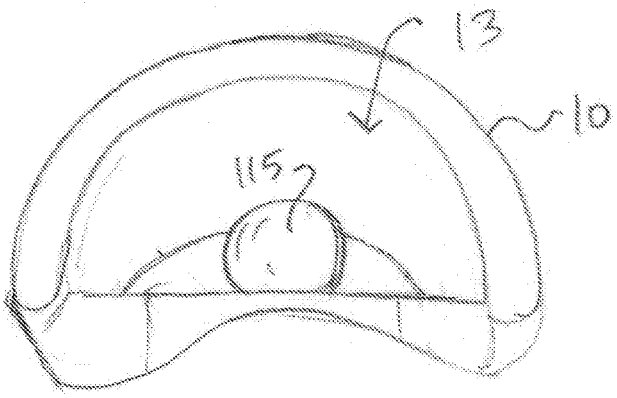
FIG. 15D is a rear view corresponding to FIGS. 15A and 15B.

(s) Fingernail Receiving Slot with Friction Bump Therein:

FIGS. 15B to 15D show an optional embodiment of pick 10 having a fingernail receiving slot 13 having a friction bump 115 therein. In operation, the distal end of the cantilevered portion of the musician's fingernail is inserted above the top of friction bump 115. Friction bump 115 then compresses slightly underneath the end of the fingernail such that friction bump 115 helps secure pick 10 onto the musician's fingernail.

Figure 16:
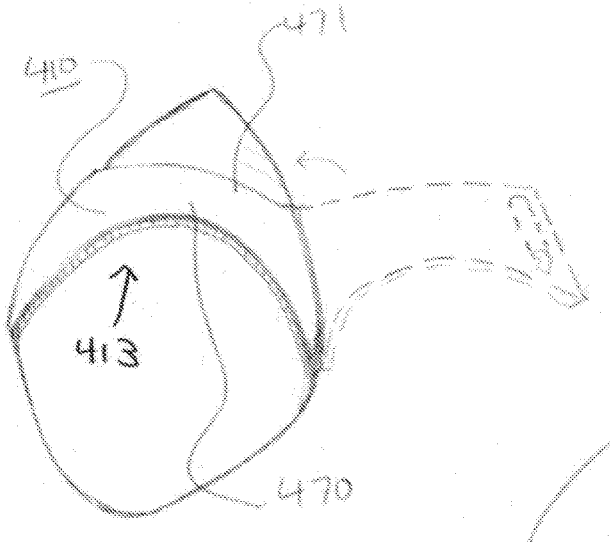
FIG. 16 is a first bottom perspective view of an alternate embodiment of the fingernail pick having a snap-fit mechanism to enclose the cantilevered portion of the fingernail.
Figure 17:
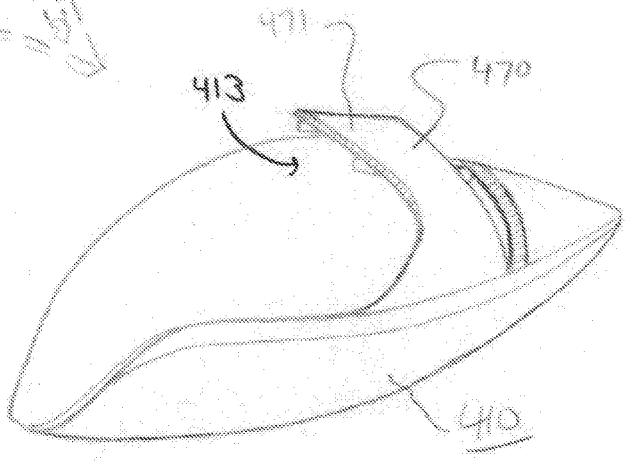
FIG. 17 is a second bottom perspective view of the fingernail pick of FIG. 16.
Figure 18:
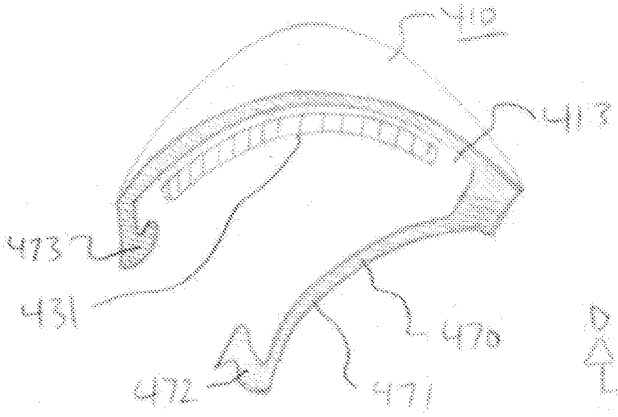
FIG. 18 is a sectional elevation view of another embodiment of the fingernail pick having a snap-fit mechanism to enclose the cantilevered portion of the fingernail, taken along line D-D in FIG. 19.
Figure 19:
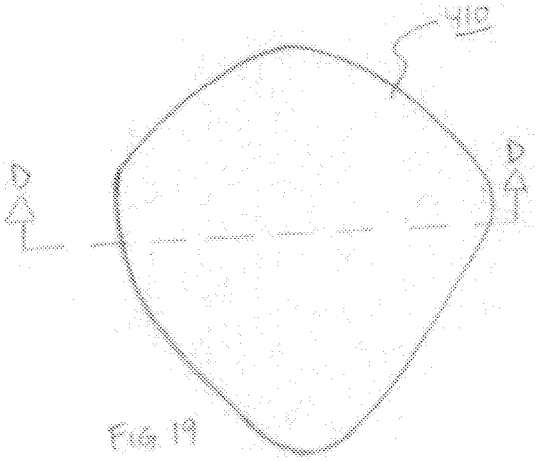
FIG. 19 is a top plan view of the fingernail pick of FIG. 28.

(t) Snap-Fit Opening Fingernail Slot:

FIGS. 16-19 show an embodiment of a fingernail pick, such as fingernail pick 410. FIGS. 16-17 show perspective views, while FIG. 18 shows a section cut at line D-D in the top view of FIG. 19. Pick 410 is similar to pick 10 except that the fingernail receiving slot 413 includes a snap-fit mechanism 470 to secure pick 410 to the cantilevered portion 431 of the fingernail. Snap-fit mechanism 470 comprises flexible slot bottom 471 that opens and closes like a door and a latch mechanism 472 that latches bottom 471 to receiver 473 and secures pick 470 to cantilevered fingernail 431. This embodiment may provide advantages over other similar embodiments since it may be possible to develop higher friction in slot 413 with snap-fit mechanism 470 since it is tightened in a direction normal to the insertion direction of fingernail 431 and thus zero friction is present during insertion. Slot friction in other embodiments, such as that described in FIGS. 12-13, must be overcome during insertion and removal, resulting in relatively lower slot friction since there is a desire to make the pick relatively easy to install—which means it will be relatively easy to slide back off.

Figure 20:
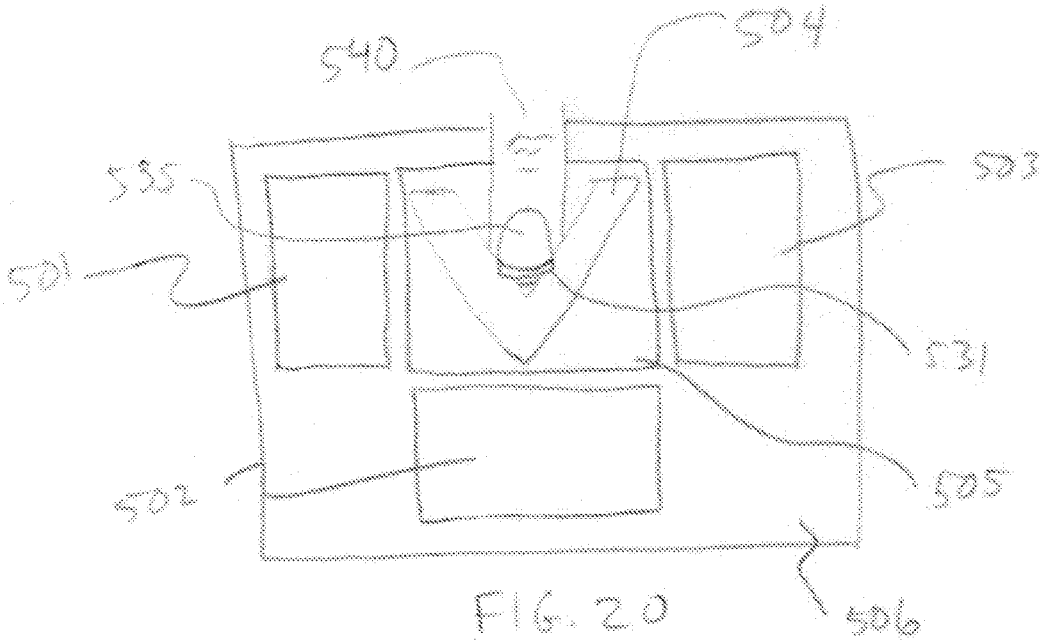
FIG. 20 is a top plan view of an optional photographic device for measuring fingernail dimensions.
Figure 21:
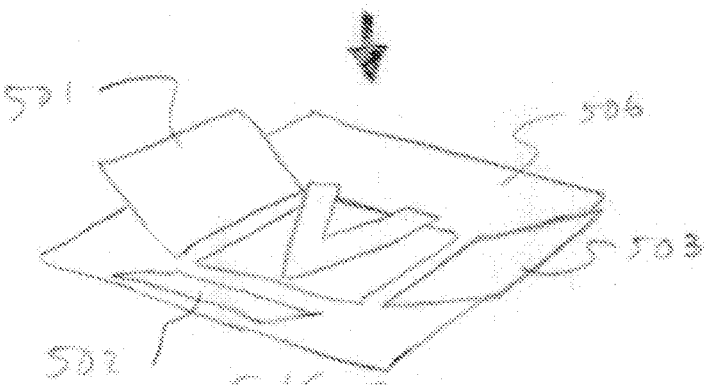
FIG. 21 is a perspective view of the optional photographic device of FIG. 20.

(u) Photographic Device for Measuring Fingernail Dimensions:

FIGS. 20-22 shows an optional measuring device, referred to herein as a "four-shot" device 500, for use in measuring relevant dimensions on the fingernail of a potential fingernail pick user. FIG. 20 shows a top view of four-shot device 500 and FIG. 21 shows a perspective view of four-shot device 500. Four-shot device comprises 3 mirrors 501, 502, 503 each mounted at an angle on a base 506 as shown and an optional stand for a camera on top (not shown here). The musician's finger 540 is placed on finger stand 505 and pushed forward onto nail stand 504, which is very thin, so that the cantilevered portion 531 of the nail rests on top of nail stand 504 and the rest of the fingertip rests below nail stand 504, as shown in FIG. 20. With the finger in this position, a photograph is now taken from a position directly above nail plate 535 pointing in the direction of the arrow in FIG. 21. Mirrors 501, 502, and 503 are positioned at approximately 45° relative to finger stand 505 so that taking a single photograph in a top-down direction results in four images: a top view, a thumb-side view, a pinky-side view, and a front view. Taking all images at once has significant benefits since very slight movements of the finger could result in measurements not being useful.

Four-shot device 500 may be used to simultaneously measure the following dimensions on a user's fingernail, such as fingernail 30 as shown in FIGS. 1-11: width (W) from fingernail end 61 to fingernail end 62, height (H) from fingernail end 61 to center of nail plate 35, proximal length (PL) from rear center of cuticle to line drawn from nail end 61 to nail end 62, total length (TL) from rear center of cuticle to center tip of cantilevered nail 36, distal length (DL) from line drawn from nail end 61 to nail end 62 to center of the root or beginning of cantilever nail (where it grows out), edge length (EL) from nail end 61 to other end of straight edge of cantilevered nail 48, approximate longitudinal distal radius (LDR) of curvature along nail from tip 36 longitudinally to line drawn from nail end 61 to nail end 62, approximate longitudinal proximal radius (LPR) of curvature along nail from center rear of nail plate 87 longitudinally to line drawn from nail end 61 to nail end 62, approximate distal lateral radius of curvature near the tip 36 along nail (RD), approximate lateral radius of curvature in the center of nail along nail from nail end 61 to nail end 62 (RC), and approximate proximal lateral radius of curvature near the rear 87 along nail (RP).

In preferred aspects, the four-shot device 500 could be used as follows. Four-shot devices 500 could be distributed to retail centers or mailed out to customers requesting them online. Once the customer has the four-shot device 500, he or she inserts fingers one at a time and takes a 4-image photo of it as described above. This photo is then physically or electronically transmitted to a technician or a computer program that measures the dimensions listed above for each finger. These dimensions are then fed into a computer program that either looks up an exact match of the requested size (which is a combination of all dimensions) and then provides the fingernail pick part number that matches or customizes a fingernail pick 3D model such that the inside dimensions match or closely match all of the measured dimensions, thereby resulting in a well-fitting fingernail pick for the user.

(v) Heater:

The present system may optionally include a heater to heat the adhesive layer 15 finger nail pick 10 to a preferred temperature such that it can stick more effectively to the top of the musician's nail plate. The heater may be air heated, ant may optionally have an internal aluminum heating structure surrounded by an acrylic body (which has poor heat conductivity). The optional heater may also function as storage container for a plurality of picks, and the picks could optionally be removed with a small tool or hook (to avoid the musician's fingers coming into contact with the hot aluminum).

The invention claimed is:

1. A fingernail pick for a stringed instrument, comprising:

a body portion having a fingernail receiving slot therein for attachment to a fingernail;

an underside playing surface for activating a string on said stringed instrument during an underside stroke; and a topside playing surface for activating said string during a topside stroke;

wherein the fingernail pick tapers from a thin proximal end adjacent to the cuticle of the fingernail to a thicker distal end at a position distal to a cantilevered portion of the fingernail.

2. The fingernail pick of claim 1, wherein the underside playing surface comprises an inwardly tapered edge and is shaped to deform a portion of a musician's fingertip.

3. The fingernail pick of claim 1, wherein the slot has sidewalls dimensioned to resist rotation of the fingernail pick caused by lateral forces on the fingernail pick.

4. The fingernail pick of claim 1, wherein the topside playing surface has a generally convex shape, and wherein the underside playing surface has a generally concave shape.

5. The fingernail pick of claim 1, wherein the underside playing surface has a substantially flat side edge.

6. The fingernail pick of claim 1, wherein the underside playing surface extends in a proximal direction from the proximal end of a cantilevered portion of a fingernail and in a distal direction from the distal end of the cantilevered portion of the fingernail.

7. The fingernail pick of claim 2, wherein a proximal end of the inwardly tapered edge of the underside playing surface is located adjacent to a thumb-side proximal end of the fingernail slot.

8. A fingernail pick for a stringed instrument, comprising:

a body portion having a fingernail slot therein for attachment to a fingernail;

an underside playing surface for activating a string on said stringed instrument during an underside stroke; and a topside playing surface for activating said string during a topside stroke;

wherein the fingernail receiving slot has sidewalls shaped to extend along the sides of the fingernail to resist rotation of the fingernail pick caused by lateral forces on the fingernail pick.

9. The fingernail pick of claim 8, wherein the underside playing surface is disposed substantially on the thumb-side of the fingernail pick and the topside playing surface is disposed substantially on the pinky-side of the fingernail pick.

10. The fingernail pick of claim 8, wherein the fingernail receiving slot has substantially straight sidewalls.

11. The fingernail pick of claim 8, wherein the straight sidewalls are parallel to one another.

12. The fingernail pick of claim 8, wherein the straight sidewalls are not parallel to one another.

* * * * *